US009586803B1

(12) United States Patent
Snyker

(10) Patent No.: US 9,586,803 B1
(45) Date of Patent: Mar. 7, 2017

(54) BOTTLE RACK DISPENSER APPARATUS

(71) Applicant: Tailor Made Products, Inc., Oconomowoc, WI (US)

(72) Inventor: Mark Omer Snyker, Apple Valley, MN (US)

(73) Assignee: Tailor Made Products, Inc., Oconomowoc, WI (US)

( * ) Notice: Subject to any disclaimer, the term of this patent is extended or adjusted under 35 U.S.C. 154(b) by 0 days.

(21) Appl. No.: 15/238,903

(22) Filed: Aug. 17, 2016

(51) Int. Cl.
*A47B 73/00* (2006.01)
*B67D 3/00* (2006.01)
*A47B 87/02* (2006.01)

(52) U.S. Cl.
CPC ..... *B67D 3/0087* (2013.01); *B67D 3/0029* (2013.01); *B67D 3/0051* (2013.01); *A47B 73/00* (2013.01); *A47B 87/02* (2013.01)

(58) Field of Classification Search
CPC .. B67D 3/0087; B67D 3/0029; B67D 3/0051; A47B 73/00; A47B 87/02
USPC ..... 211/74, 194, 85.18, 49.1, 188, 133.1; 220/23.91, 23.88, 23.89, 23.86; 222/173, 222/184, 185.1, 143; 108/180, 186, 57.13
See application file for complete search history.

(56) References Cited

U.S. PATENT DOCUMENTS 778,012 A * 12/1904 Conover ..... F24F 3/1603 222/108
1,017,756 A 2/1912 Head
D45,362 S * 3/1914 Woodside ..... 248/105
1,633,083 A * 6/1927 Fite, Jr. ..... A61J 9/0638 211/74
1,688,412 A * 10/1928 Darby ..... A63B 55/00 211/133.1
1,706,213 A * 3/1929 Cordley ..... F25D 31/002 222/108
1,938,126 A 12/1933 Thompson
2,321,836 A 6/1943 Marzo
2,339,366 A * 1/1944 Williams ..... B65D 47/42 222/185.1
2,554,570 A * 5/1951 Harvey ..... G01F 11/08 222/207
2,685,978 A * 8/1954 Crockett ..... B67D 1/0456 215/283
2,919,814 A * 1/1960 Berkowitz ..... A47F 7/281 211/74
(Continued)

*Primary Examiner* — Joshua J Michener
*Assistant Examiner* — Devin Barnett
(74) *Attorney, Agent, or Firm* — Brian G. Gilpin; Godfrey & Kahn, S.C.

(57) ABSTRACT

A dispenser cradle is disclosed that includes a front portion, a neck channel situated in the front portion and configured for receiving a neck of a dispensing bottle therethrough, a central channel configured for supporting the dispensing bottle thereon, where the central channel further includes a channel ramp portion extending from proximate the rear wall to a channel aperture, and where the channel aperture is configured for receiving a shoulder portion of the dispensing bottle therethrough when the dispensing bottle is positioned in at least one of a primary position and a secondary position, and when the dispensing bottle is in the primary position, a central axis of the dispensing bottle is situated at a first angle relative to a horizontal axis, and when the dispensing bottle is in the secondary position, a central axis of the dispensing bottle is situated at a second angle relative to the horizontal axis.

16 Claims, 10 Drawing Sheets

(56) References Cited

U.S. PATENT DOCUMENTS 2,944,780 A * 7/1960 Monk ..... A47B 87/0223 108/186
3,085,718 A * 4/1963 Nelson ..... A47F 1/08 222/168
3,286,849 A * 11/1966 Dominos ..... B67C 9/00 141/106
3,606,023 A * 9/1971 Edmunds ..... A47B 73/006 211/194
3,682,323 A * 8/1972 Bergquist ..... B01L 9/06 108/110
3,814,293 A 6/1974 Daves
3,827,572 A 8/1974 Cockrum
D233,878 S * 12/1974 Berger ..... 211/74
3,870,155 A * 3/1975 Galloway ..... A47B 73/006 211/188
3,893,569 A * 7/1975 Hoch ..... A47B 31/06 108/44
4,003,503 A * 1/1977 Aldridge ..... B65D 47/06 222/173
4,271,878 A * 6/1981 Bologa ..... B67C 9/00 141/106
4,442,778 A * 4/1984 Lang ..... A47B 87/0246 108/156
4,515,334 A * 5/1985 Horne ..... A47B 73/00 211/74
4,620,637 A * 11/1986 Karashima ..... A47B 96/00 211/126.1
4,706,824 A * 11/1987 Mercer ..... A47F 5/118 108/186
4,722,463 A * 2/1988 Anderson ..... B67D 3/00 137/588
4,844,290 A * 7/1989 McCurdy ..... B67D 3/00 222/185.1
4,898,282 A * 2/1990 Hawkinson ..... A47F 1/126 211/49.1
4,901,872 A * 2/1990 Lang ..... A47B 87/0223 108/91
4,940,150 A * 7/1990 Spengler ..... A47B 87/0223 211/133.1
5,139,173 A * 8/1992 Evinger ..... A47F 1/03 222/156
D330,819 S * 11/1992 Dickinson ..... D6/675.1
D336,005 S * 6/1993 Keup ..... D7/313
D336,408 S * 6/1993 Tersch ..... D6/682
5,215,199 A * 6/1993 Bejarano ..... A47B 55/02 211/181.1
5,370,245 A 12/1994 Tersch et al.
5,417,333 A * 5/1995 Flum ..... A47B 87/007 211/194
D361,131 S * 8/1995 Leopold ..... D24/199
5,624,043 A * 4/1997 Baptista ..... A47G 23/0241 211/60.1
D385,080 S * 10/1997 Schueneman ..... D34/38
5,709,158 A * 1/1998 Wareheim ..... A47B 96/021 108/180
D425,375 S * 5/2000 Parham ..... D7/619.1
6,079,339 A * 6/2000 Houk, Jr. ..... A47B 87/0223 108/157.13
6,135,297 A 10/2000 DeShazo et al.
6,196,263 B1 * 3/2001 Woodruff ..... G01F 13/00 137/565.11
6,290,074 B1 * 9/2001 Syvuk ..... A47F 7/283 211/133.1
6,386,393 B1 * 5/2002 Paulovich ..... B67D 3/0029 211/80
6,511,027 B1 * 1/2003 Yu ..... B67D 3/0029 211/74
6,776,378 B1 * 8/2004 Yu ..... A47B 73/00 211/74
6,808,149 B1 * 10/2004 Sendowski ..... A47K 5/13 211/75
6,811,042 B2 11/2004 Kelly et al.
6,832,744 B1 * 12/2004 Pitt ..... A47G 23/0241 248/146
D501,338 S * 2/2005 Deasy ..... D6/678.1
D536,933 S * 2/2007 Perlman ..... D7/619.1
D562,081 S * 2/2008 Ambach ..... D7/619.1
D578,355 S * 10/2008 Arney ..... D7/601
7,490,798 B2 * 2/2009 Mann ..... A47G 23/0241 141/319
7,914,016 B2 * 3/2011 Guttormson ..... B62B 1/12 211/74
8,464,913 B2 * 6/2013 Yoon ..... D06F 39/022 222/185.1
8,671,644 B2 * 3/2014 Huang ..... A47B 13/06 108/155
8,777,019 B2 * 7/2014 Dovell ..... A45C 11/20 211/194
8,870,024 B2 * 10/2014 Mendes ..... A47F 1/03 221/115
8,881,918 B2 * 11/2014 Nally ..... A63B 67/06 108/147.13
9,149,135 B2 * 10/2015 Dovell ..... A47F 7/283
D747,177 S * 1/2016 McGinty ..... D8/349
D766,051 S * 9/2016 LaRiviere ..... D7/701
2002/0000418 A1 * 1/2002 Miller, Jr. ..... A47F 5/0018 211/188
2003/0034359 A1 * 2/2003 Lassota ..... B67D 1/06 222/185.1
2003/0051644 A1 * 3/2003 Chaudoreille ..... A47B 87/0215 108/180
2003/0146180 A1 * 8/2003 Craft ..... A47B 87/0223 211/188
2004/0026346 A1 * 2/2004 Kelly ..... A47B 87/0207 211/74
2006/0283824 A1 * 12/2006 Farley ..... F17C 13/085 211/188
2011/0036798 A1 * 2/2011 Chen ..... A47B 47/0008 211/188
2012/0111889 A1 * 5/2012 Huff ..... A01G 25/09 222/143
2012/0292346 A1 * 11/2012 Watson ..... D06F 39/022 222/185.1
2012/0318824 A1 * 12/2012 McKenna ..... B65D 77/067 222/185.1
2013/0055604 A1 * 3/2013 Herman Baran ..... A47B 45/00 40/606.03
2013/0233890 A1 * 9/2013 Melzer ..... C02F 1/003 222/189.06
2014/0252040 A1 * 9/2014 Shoup ..... B67D 3/0083 222/160
2016/0137345 A1 * 5/2016 Grodsky ..... A61C 1/082 222/143
2016/0157605 A1 * 6/2016 Grad ..... A47B 47/0083 108/189

* cited by examiner

BOTTLE RACK DISPENSER APPARATUS

FIELD OF THE INVENTION

The dispenser apparatus relates to storing and dispensing liquids from a bottle.

BACKGROUND

Large bottles for storing liquids, such as drinking water, can be found in various types of establishments, for example, offices, warehouses, etc. Generally, a storage rack is provided to store several bottles of water until needed and then the bottles are removed from the storage rack, inverted, and placed on a dispensing pod. The dispensing pod generally includes a top mounting area for receiving a bottle thereon, a petcock for controlling the flow of liquid from a spout, and an aesthetic housing having a horizontal footprint. Often an establishment, such as a small office or warehouse, has limited available floor space and finds the storage racks and dispensing pod to be problematic as they jointly consume too much floor space and impede the movement of people and machines, potentially creating a hazardous situation.

SUMMARY

In at least one embodiment, an exemplary dispenser cradle is disclosed that includes: a front portion having a first support arm and a second support arm; a neck channel situated at least partially between the first support arm and second support arm configured for receiving a neck of a dispensing bottle therethrough; a central channel extending between a rear wall, a first sidewall, a second sidewall and the front portion, and configured for supporting the dispensing bottle thereon; a channel aperture having a channel aperture perimeter surface formed in the channel, where the central channel further includes a channel ramp portion extending from proximate the rear wall to the channel aperture, and where the channel aperture is configured for receiving a shoulder portion of the dispensing bottle therethrough when the dispensing bottle is positioned in at least one of a primary position and a secondary position; a shoulder support surface extending within the channel and situated substantially between the front portion and the channel aperture, where the primary shoulder support surface is angled relative to the channel ramp portion and is configured to support a shoulder portion of the dispensing bottle, when the dispensing bottle is in at least one of the primary position and secondary position; and when the dispensing bottle is in the primary position, a central axis of the dispensing bottle is situated at a first angle relative to a horizontal axis extending along a bottom portion of the dispenser cradle, and when the dispensing bottle is in the secondary position, a central axis of the dispensing bottle is situated at a second angle relative to the horizontal axis that is greater than the first angle.

BRIEF DESCRIPTION OF THE DRAWINGS

Embodiments of a dispenser apparatus are disclosed with reference to the accompanying drawings, which are for illustrative purposes. The dispenser apparatus is not limited in its application to the details of construction or the arrangement of the components illustrated in the drawings. The dispenser apparatus is capable of other embodiments or of being practiced or carried out in other various ways. In the drawings.

DETAILED DESCRIPTION

Figure 1:
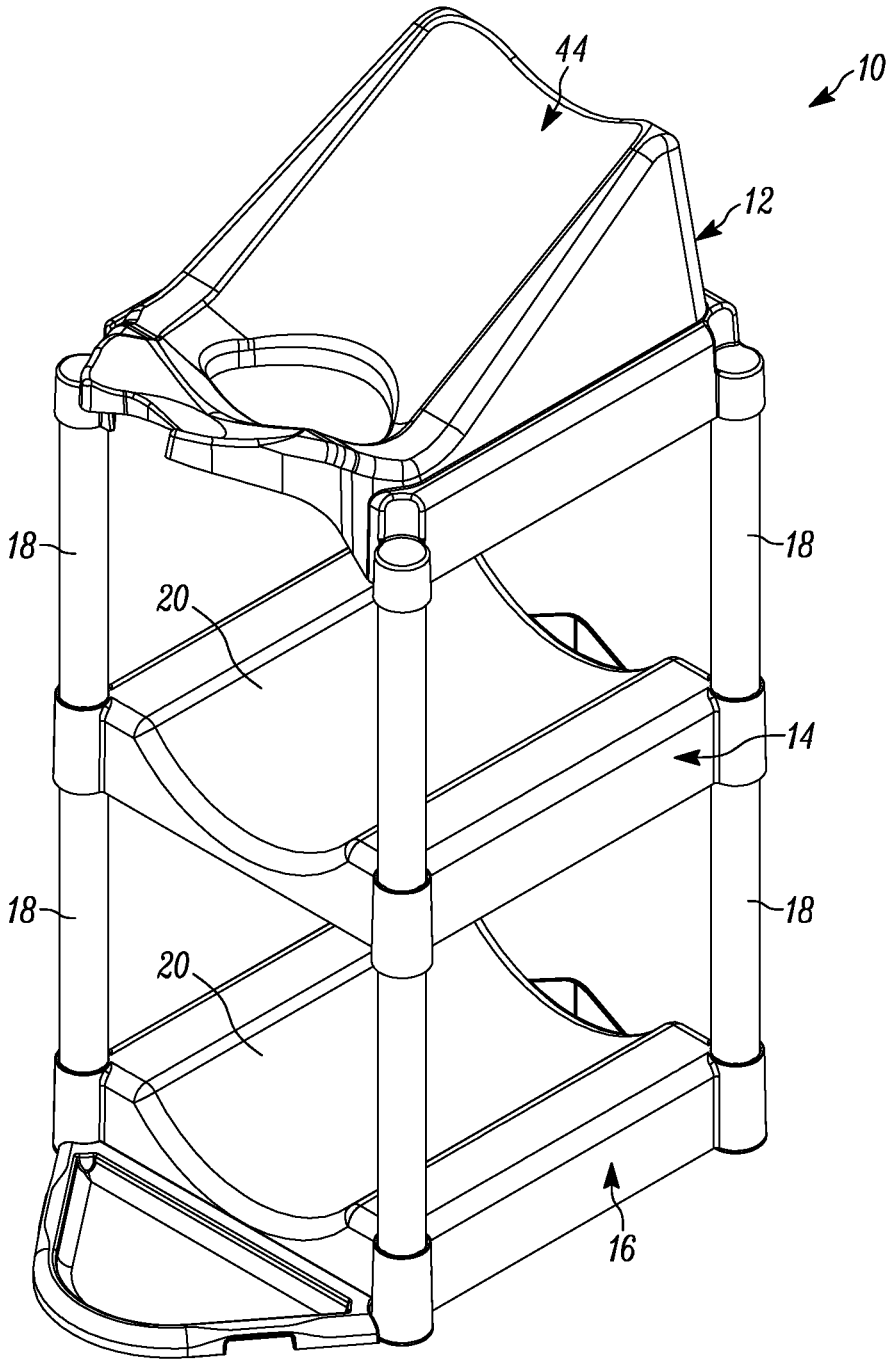
FIG. 1 illustrates a front perspective view of an exemplary dispenser apparatus that includes a dispenser cradle and a plurality of storage cradles.
Figure 2:
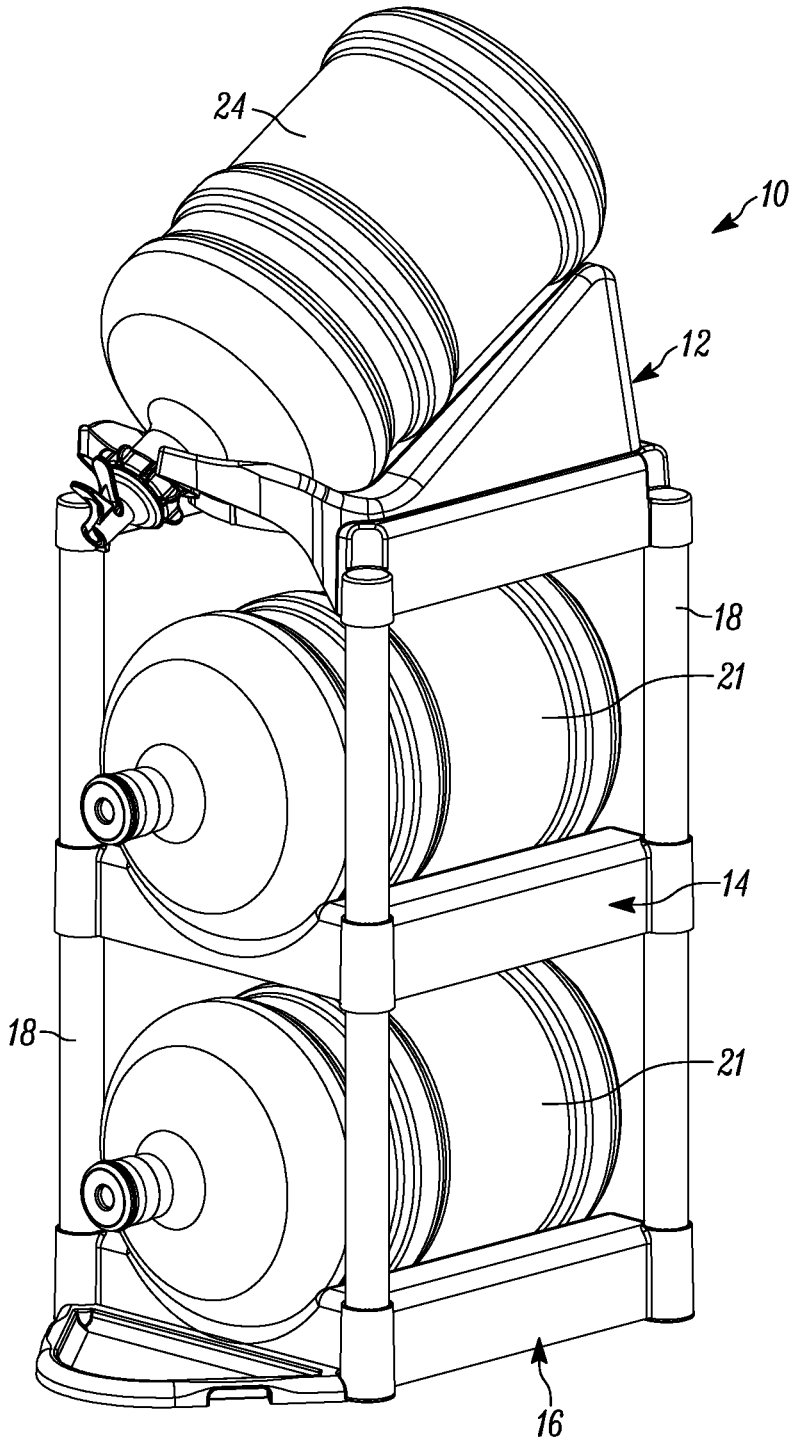
FIG. 2 illustrates the dispenser apparatus of FIG. 1, with several illustrative water bottles resting on the apparatus.

Referring to FIG. 1, an exemplary dispenser apparatus 10 is provided that includes a dispenser cradle 12, a plurality of storage cradles, such as a first storage cradle 14 and a second storage cradle 16. The dispenser cradle 12 and storage cradles 14, 16 are interconnected by a plurality of legs 18 for support. In the illustrated embodiment, the dispenser apparatus 10 includes two storage cradles 14, 16, with four legs 18 extending from the dispenser cradle 12 and storage cradle 14, with storage cradle 16 resting on a floor surface. In other embodiments, the dispenser apparatus 10 can include more or less storage cradles and more or less legs of various shapes to provide enlarged or reduced storage capacity. As shown in FIG. 1, in at least some embodiments, each storage cradle 14, 16 can include a support channel 20 extending along the length, which substantially conforms with the shape of a bottle to be stored thereon, while in other embodiments, the storage cradle 14, 16 can include various other shapes and portions suitable for storing a bottle thereon in a substantially horizontal position. FIG. 2 illustrates exemplary placement of storage bottles 21 and a dispensing bottle 24, on the dispenser apparatus 10.

Figure 3:
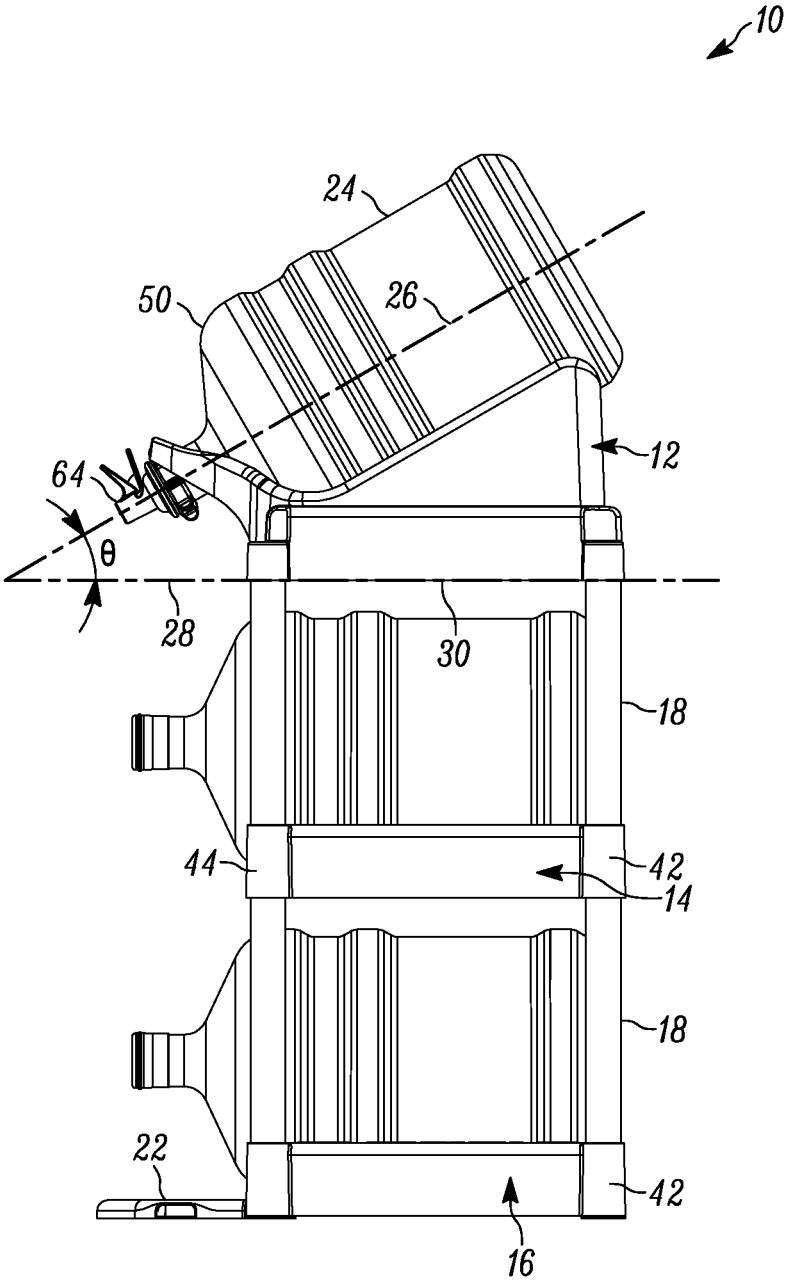
FIG. 3 illustrates a side view of the dispenser apparatus FIG. 2 with a dispensing bottle on the dispenser cradle in a primary dispensing position.

FIG. 3 illustrates the dispenser apparatus 10 with a dispensing bottle 24 (e.g., a water jug) resting on the dispenser cradle 12 in a primary position. The primary position situates a longitudinal central axis 26 of the dispensing bottle 24 at an angle θ relative to a horizontal axis 28 extending along a bottom portion 30 of the dispenser cradle 12. As shown, θ equals approximately thirty degrees, although in other embodiments, θ can be less than or greater than thirty degrees, such as twenty-five degrees, thirty-five degrees, etc. In this position, the dispensing bottle 24 is full of liquid and therefore substantially supported along its length.

Figure 4:
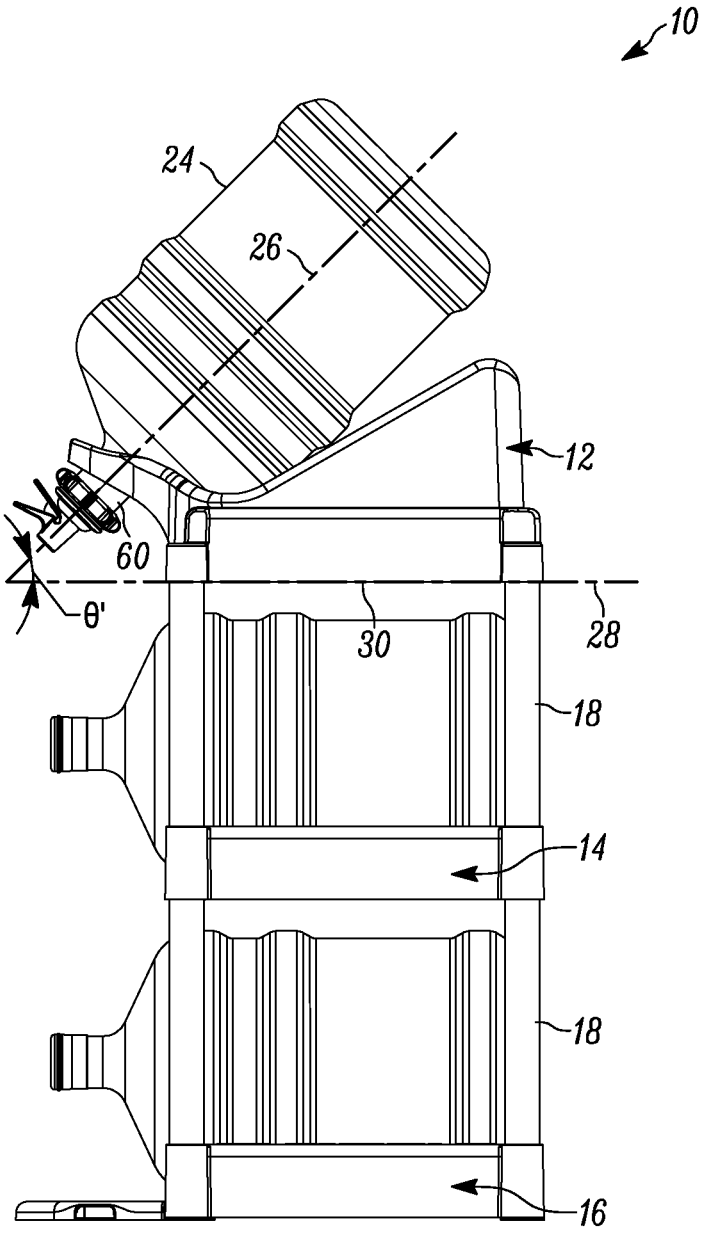
FIG. 4 illustrates a side view of the dispenser apparatus of FIG. 2 with the dispensing bottle on the dispenser cradle in a secondary dispensing position.

FIG. 4 illustrates the dispenser apparatus 10 with a dispensing bottle 24 resting on the dispenser cradle 12 in a secondary position. In the secondary position θ equals approximately forty-five degrees, although in other embodiments, θ can be less than or greater than forty-five degrees, such as forty degrees, fifty degrees, etc. In this position, the dispensing bottle 24 is partially devoid of liquid (via consumption) and therefore requires less support, allowing the dispensing bottle 24 to be tilted further to and to assist with dispensing the remaining liquid therein.

Figure 5:
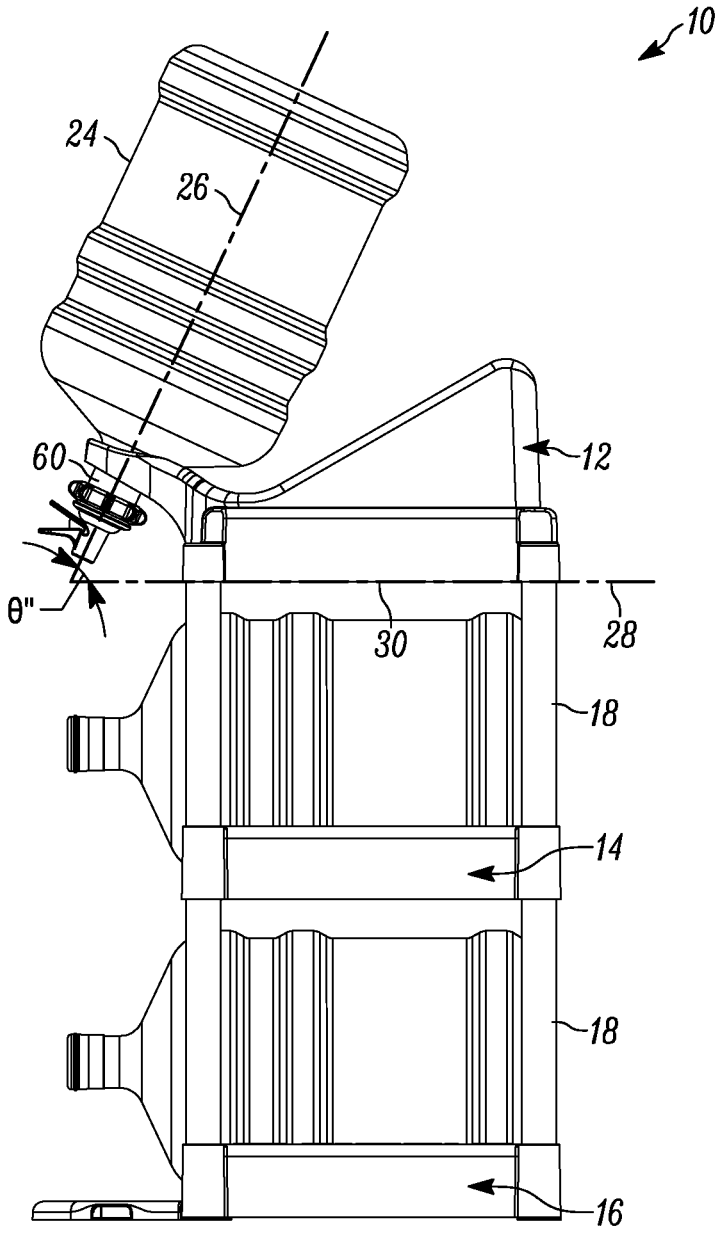
FIG. 5 illustrates a side view of the dispenser apparatus of FIG. 2 with the dispensing bottle on the dispenser cradle in a tertiary dispensing position.
Figure 6:
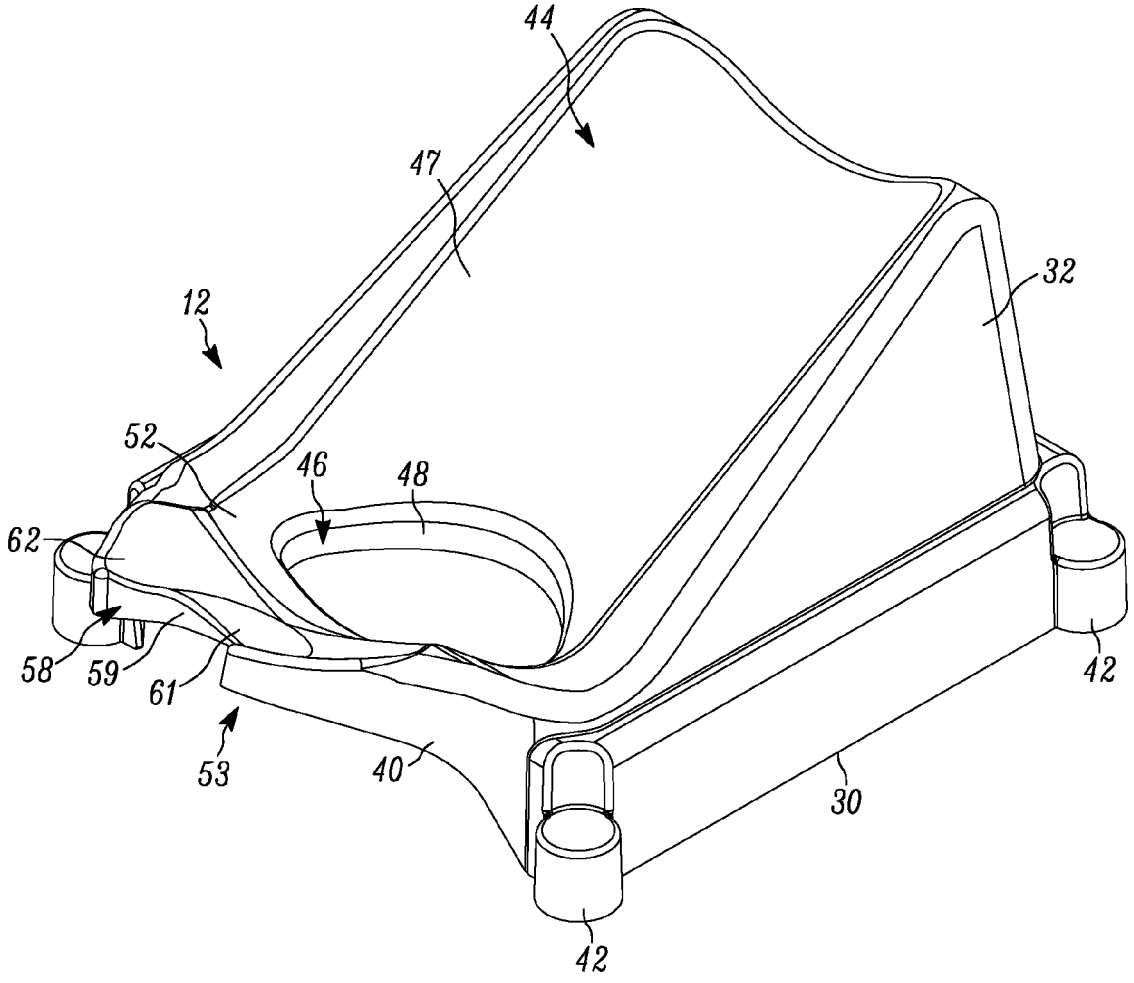
FIG. 6 illustrates a front perspective view of the dispenser cradle.
Figure 7:
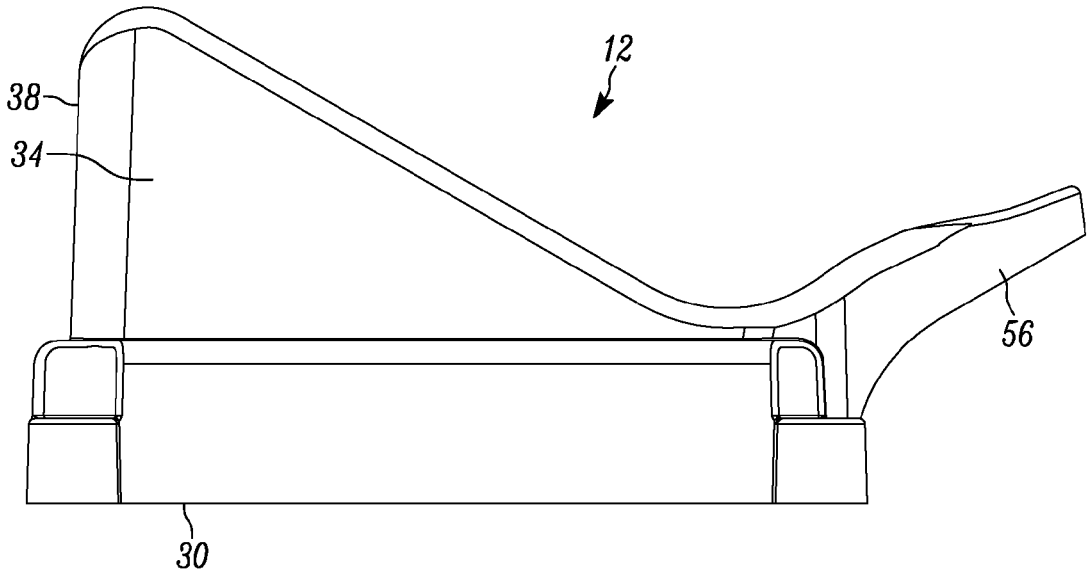
FIG. 7 illustrates a first side view of the dispenser cradle.
Figure 8:
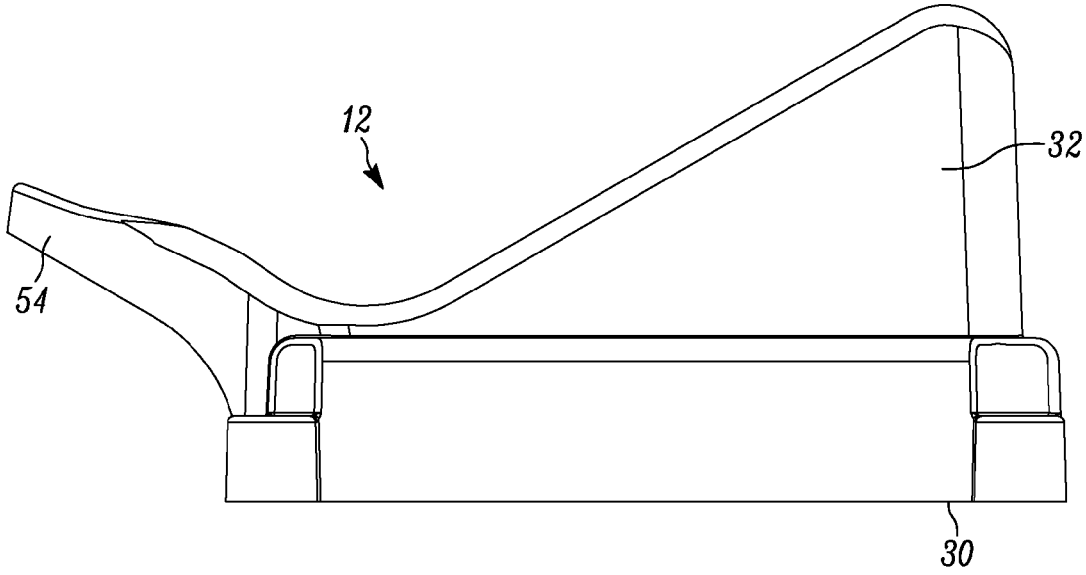
FIG. 8 illustrates a second side view of the dispenser cradle.
Figure 9:
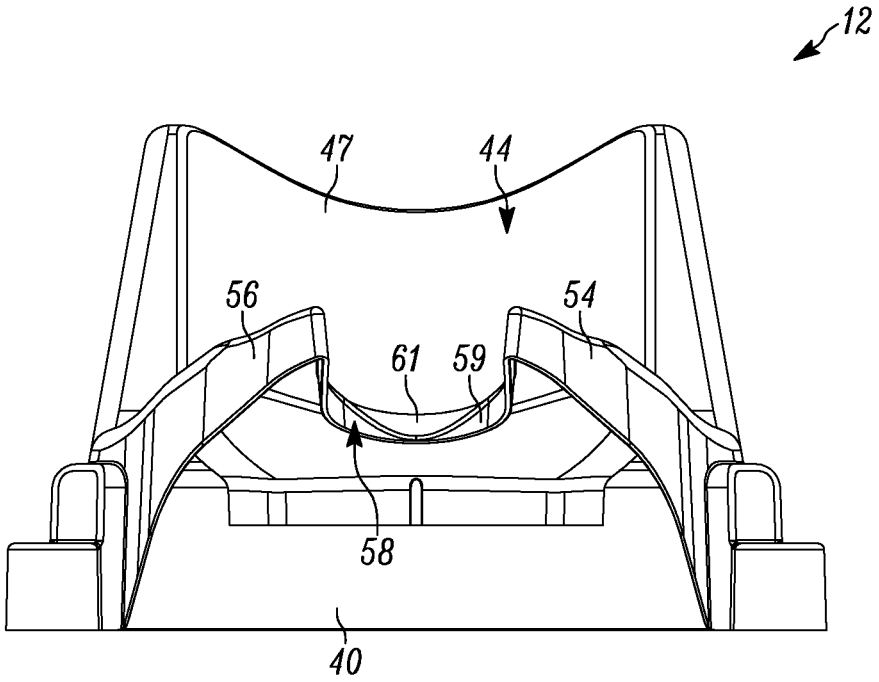
FIG. 9 illustrates a front view of the dispenser cradle.
Figure 10:
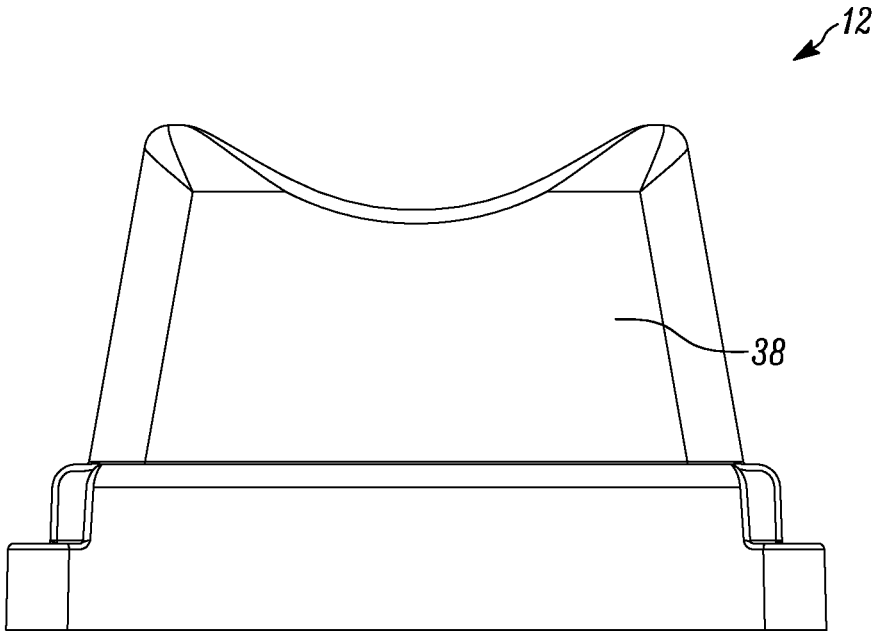
FIG. 10 illustrates a rear view of the dispenser cradle.
Figure 11:
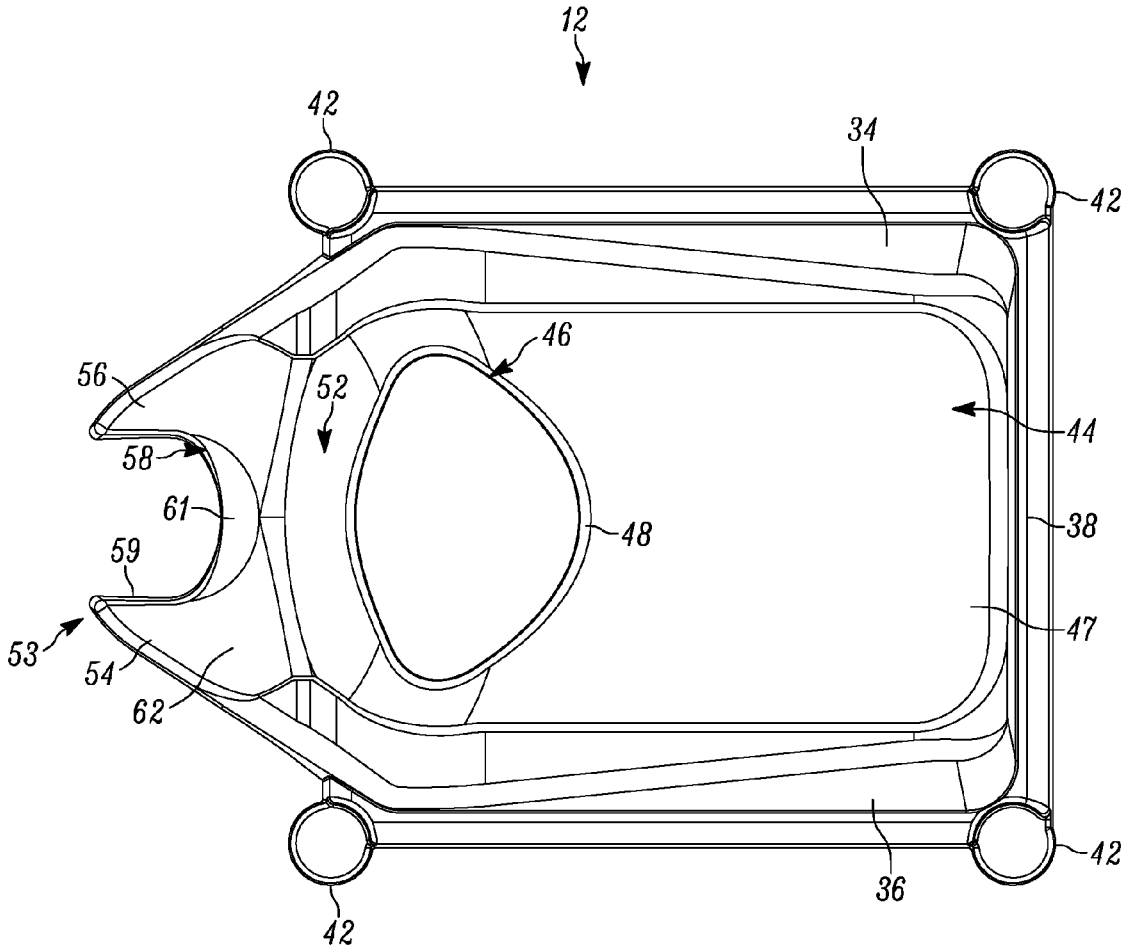
FIG. 11 illustrates a top view of the dispenser cradle.
Figure 12:
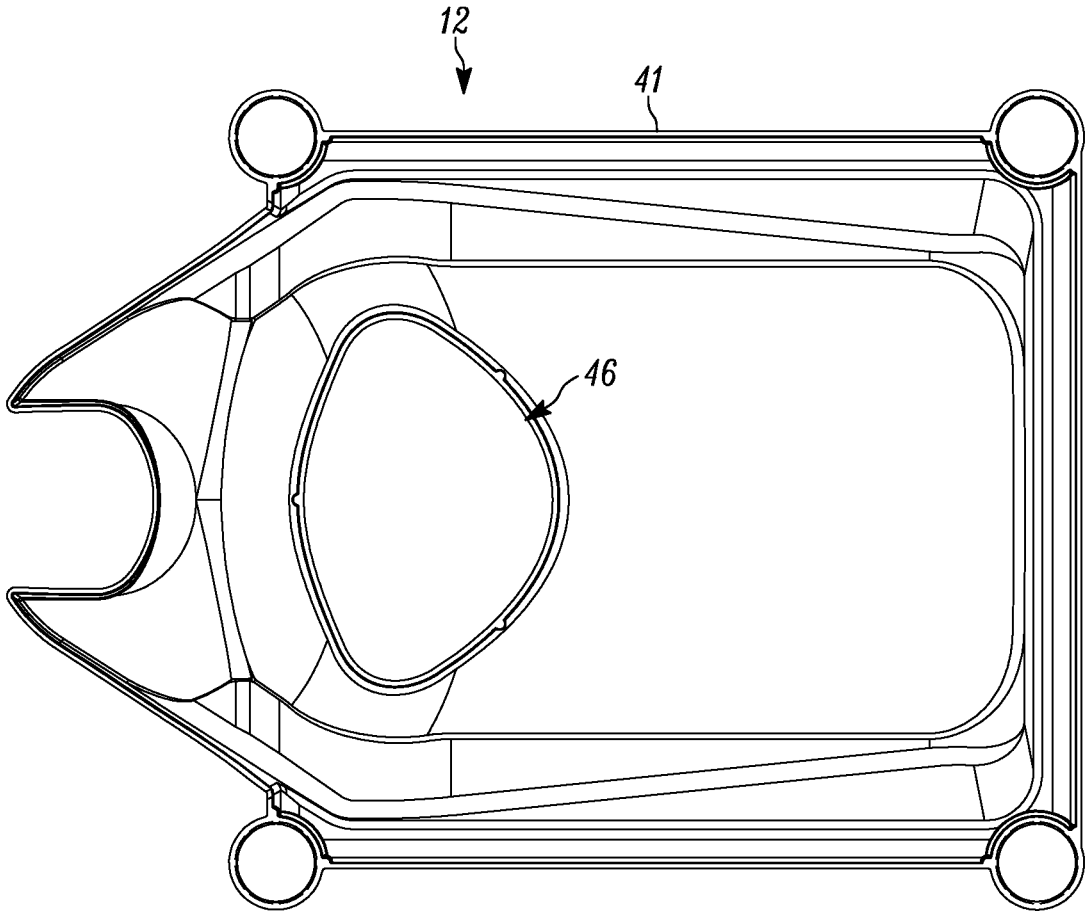
FIG. 12 illustrates a bottom view of the dispenser cradle.

FIG. 5 illustrates the dispenser apparatus 10 with a dispensing bottle 24 resting on the dispenser cradle 12 in a tertiary position. In the tertiary position θ equals approximately sixty-five degrees, although in other embodiments, θ can be less than or greater than sixty-five degrees, such as sixty degrees, seventy degrees, etc. In this position, the dispensing bottle 24 is substantially devoid of liquid and therefore can be tilted yet further to assist with dispensing the remaining liquid therein.

Referring now to FIGS. 6-11, in at least some embodiments, the dispenser cradle 12 includes a first sidewall 34, a second sidewall 36, a rear wall 38, and a front wall 40, all of which can include a one or more tiered portions extending to a bottom perimeter 41. A plurality of leg supports 42 can be provided about the corners of the cradles 12, 14, 16, to matingly receive the legs 18 and provide a stable connection there between. In at least some embodiments, the leg supports 42 can be located in other portions. Further, in at least some embodiments, the legs 18 can be integrally molded or otherwise secured to the cradles 12, 14, 16.

The dispenser cradle 12 further includes a central channel 44 that extends substantially between the sidewalls 34, 36, rear wall 38 and proximate to the front wall 40. The channel 44 is sized and shaped to receive and support dispensing bottle 24 in at least the primary position, in a manner that maintains the dispensing bottle 24 in a substantially secure manner to prevent it from rolling off the dispenser cradle 12. The channel 44 further includes a channel ramp portion 47 extending from proximate the rear wall 38 to a channel aperture 46, the channel aperture having a channel aperture perimeter surface 48. In at least some embodiments, the channel aperture 46 and channel aperture perimeter surface 48 are sized and shaped to matingly receive a portion of a dispensing bottle shoulder 50 (FIG. 3). Further, in at least some embodiments, the channel aperture 46 does not extend therethrough, thereby comprising only a recess. Adjacent and partially surrounding the channel aperture 46 is a shoulder support surface 52 that extends within the channel 44 to matingly receive and support a portion of the dispensing bottle shoulder 50 when the dispensing bottle 24 is in at least the secondary position. In the secondary position the dispensing bottle 24 is at least partially raised above the channel ramp portion 47 and is supported at least in part by the shoulder support surface 52. As such, in at least some embodiments, the shoulder support surface 52 is curved to match the contour of the dispensing bottle shoulder 50.

The dispenser cradle 12 further includes a front portion 53 having a first support arm 54 and a second support arm 56, where the support arms 54, 56 are separated at least partially by a neck channel 58, and which in at least some embodiments, can be an enclosed by the support arms 54, 56. The neck channel 58 is sized and shaped to receive therethrough a dispensing bottle neck 60 (FIG. 4) while a top surface 62 of the support arms 54, 56 supports the dispensing bottle shoulder 50 when the dispensing bottle 24 is in the tertiary position. The neck channel 58 further includes a neck support wall 59 and a curved neck depression 61 that is angled with respect to the neck support wall 59 and the top surface 62, and is sized and shaped to receive and stabilize the dispensing bottle neck 60 when the dispensing bottle 24 is in the secondary and tertiary positions. Alternatively, support arms 54, 56 could be connected at their distal ends to create a closed loop around neck channel 58. Such a configuration would have a top surface 62 that would be continuous in its support of the dispensing bottle shoulder 50 when the dispensing bottle 24 is in the tertiary position.

By utilizing the multi-angled surface of the dispenser cradle 12 to engage the dispensing bottle 24, the dispensing bottle 24 can be rested in the primary position when full of liquid and heavy. Once the quantity of liquid therein has been reduced via consumption from the bottle by a user, such as by utilizing a dispensing spout assembly 64 (FIG. 3), the dispensing bottle 24, now lighter and more stable at increased angles, can be shifted to the secondary position for further consumption. Finally, as the dispensing bottle 24 becomes substantially devoid of liquid, the dispensing bottle 24 can be shifted to the tertiary position. In this manner, the dispenser cradle 12 provides a means to store and dispense liquid from the dispensing bottle, without the need to utilize horizontal floor space in an establishment to provide drinking water access. More particularly, the storage cradles 14, 16 can be vertically stacked via the legs 18 to store full or empty bottles, while the dispenser cradle 12 is vertically stacked thereabove, requiring no additional floor space. In contrast, the use of a dispensing pod not only requires additional horizontal floor space, but also requires additional cleaning and maintenance.

Although the dispenser apparatus 10 has been described with reference to a dispenser cradle 12 and storage cradles 14, 16, the dispenser apparatus 10 can include no storage cradles and instead be placed on a shelf or surface to serve as dispenser without the need for a separate dispensing pod. The dispenser apparatus 10 can be formed from any one or more of numerous types of materials, such as plastic, etc. In addition, all, some, or none of the aforementioned components can be integrally formed.

The general dimensions of the components and angular surfaces, such as the channels, cradles, legs, front portion, primary shoulder support, etc. can vary to accommodate various sizes of bottles, such as three-gallon, four-gallon, and five-gallon, although in at least some embodiments, the dimensions support a standard five-gallon water bottle used extensively in commercial applications.

It is specifically intended that the dispenser apparatus not be limited to the embodiments and illustrations contained herein, but include modified forms of those embodiments including portions of the embodiments and combinations of elements of different embodiments as come within the scope of the following claims.

I claim:

1. A dispenser apparatus comprising: a dispenser cradle comprising:

a front portion having a first support arm and a second support arm at a distal end of the dispenser cradle; a neck opening situated at least partially between the first support arm and second support arm configured for receiving a neck of a dispensing bottle therethrough;

a recessed central channel extending between a rear wall, a first sidewall, a second sidewall and the front portion, and configured for supporting the dispensing bottle thereon;

a channel aperture defining a through hole in the channel of the dispenser cradle, where the central channel further includes an inclined channel ramp portion extending downwardly from proximate the rear wall to the channel aperture, and where the channel aperture is configured for receiving a shoulder portion of the dispensing bottle therein when the dispensing bottle is positioned in at least one of a freestanding primary position and a freestanding secondary position;

a shoulder support surface extending within the channel and situated substantially between the front portion and the channel aperture, where the shoulder support surface is angled relative to the channel ramp portion and is configured to support a shoulder portion of the dispensing bottle when the dispensing bottle is in at least one of the freestanding primary position and the freestanding secondary position; and when the dispensing bottle is in the freestanding primary position, a central axis of the dispensing bottle is situated at a first angle relative to a horizontal axis extending along a bottom portion of the dispenser cradle, and when the dispensing bottle is in the freestanding secondary position, the central axis of the dispensing bottle is situated at a second angle relative to the horizontal axis that is greater than the first angle; and a top surface formed on at least part of the front portion and extending proximate to the shoulder support surface, where the first support arm and second support arm are angled upwardly relative to the shoulder support surface and is configured to support the shoulder portion of the dispensing bottle when the dispensing bottle is in a freestanding tertiary position, and when the dispensing bottle is in the freestanding tertiary position the central axis of the dispensing bottle is situated at a third angle relative to the horizontal axis extending along a bottom portion of the dispenser cradle; a storage cradle secured below the dispenser cradle including a support channel for supporting a storage bottle in a substantially horizontal position; and a plurality of legs situated between the dispenser cradle and storage cradle to support the dispenser cradle in a fixed position above the storage cradle.

2. The apparatus of claim 1, where the dispenser cradle, legs and storage cradle are integrally formed.

3. The apparatus of claim 1, further including a second storage cradle secured to the first storage cradle by additional legs, where the second storage cradle is positioned below the first storage cradle, and where the dispenser cradle remains parallel to the first and second storage cradles when the dispensing bottle is in each of the primary, secondary, and tertiary positions.

4. The apparatus of claim 1, where the first angle is between about 25 degrees and about 35 degrees and the second angle is between about 40 degrees and about 50 degrees.

5. The apparatus of claim 4, where the third angle is between about 55 degrees and 75 degrees.

6. The apparatus of claim 1, where the first angle is between about 15 degrees and about 40 degrees and the third angle is between about 55 degrees and 75 degrees.

7. The apparatus of claim 1, where the first angle is between about 0 degrees and about 40 degrees and second angle is between about 41 degrees and about 60 degrees, and the third angle is between about 61 degrees and about 85 degrees.

8. A dispenser apparatus comprising: a dispenser cradle comprising:

a front portion having a first support arm and a second support arm at a distal end of the dispenser cradle; a neck opening channel situated at least partially between the first support arm and second support arm configured for receiving a neck of a dispensing bottle therethrough;

a recessed central channel extending between a rear wall, a first sidewall, a second sidewall and the front portion, and configured for supporting the dispensing bottle thereon;

a channel aperture defining a through hole in the channel of the dispenser cradle, where the central channel further includes an inclined channel ramp portion extending downwardly from proximate the rear wall to the channel aperture, and where the channel aperture is configured for receiving a shoulder portion of the dispensing bottle therein when the dispensing bottle is positioned in at least one of a freestanding primary position and a freestanding secondary position;

a shoulder support surface extending within the channel and situated substantially between the front portion and the channel aperture, where the shoulder support surface is angled relative to the channel ramp portion and is configured to support a shoulder portion of the dispensing bottle when the dispensing bottle is in at least one of the freestanding primary position and the freestanding secondary position; and when the dispensing bottle is in the freestanding primary position, a central axis of the dispensing bottle is situated at a first angle relative to a horizontal axis extending along a bottom portion of the dispenser cradle, and when the dispensing bottle is in the freestanding secondary position, the central axis of the dispensing bottle is situated at a second angle relative to the horizontal axis that is greater than the first angle; and a top surface formed on at least part of the front portion and extending proximate to the shoulder support surface, where the first support arm and second support arm are angled upwardly relative to the shoulder support surface and is configured to support the shoulder portion of the dispensing bottle when the dispensing bottle is in a freestanding tertiary position, and when the dispensing bottle is in the freestanding tertiary position the central axis of the dispensing bottle is situated at a third angle relative to the horizontal axis extending along a bottom portion of the dispenser cradle; wherein, when in use, the bottom portion the dispenser cradle is configured to be mounted on top of upright leg posts in order to elevate the dispenser cradle and the dispensing bottle above a support surface.

9. The apparatus of claim 8, further including a storage cradle secured below the dispenser cradle and including a support channel for supporting a storage bottle in a substantially horizontal position.

10. The apparatus of claim 8, further including a dispensing bottle situated on the dispenser cradle, where the dispensing bottle includes a dispensing spout for dispensing consumable liquid.

11. The apparatus of claim 9, wherein the leg posts are situated between the dispenser cradle and storage cradle to support the dispenser cradle in a permanently fixed position above the storage cradle when the dispensing bottle is in the primary position, secondary position, and tertiary position.

12. The apparatus of claim 8, where the first angle is between about 25 degrees and about 35 degrees and the second angle is between about 40 degrees and about 50 degrees.

13. The apparatus of claim 12, where the third angle is between about 55 degrees and 75 degrees.

14. The apparatus of claim 8, where the first angle is between about 15 degrees and about 40 degrees and the third angle is between about 55 degrees and 75 degrees.

15. The apparatus of claim 8, where the first angle is between about 0 degrees and about 40 degrees and second angle is between about 41 degrees and about 60 degrees, and the third angle is between about 61 degrees and about 85 degrees.

16. A dispenser cradle comprising: a front portion having a first support arm and a second support arm at a distal end of the dispenser cradle;

a neck opening situated at least partially between the first support arm and second support arm and configured for receiving a neck of a dispensing bottle therethrough;

a recessed central channel extending between a rear wall, a first sidewall, a second sidewall and the front portion, and configured for supporting the dispensing bottle thereon;

a channel aperture comprising a recessed depression situated in the recessed central channel of the dispenser cradle, where the central channel further includes an inclined channel ramp portion extending downwardly from proximate the rear wall to the channel aperture, and where the channel aperture is configured for receiving a shoulder portion of the dispensing bottle therein when the dispensing bottle is positioned in at least one of a freestanding primary position and a freestanding secondary position;

a shoulder support surface extending within the channel and situated substantially between the front portion and the channel aperture, wherein the shoulder support surface is angled relative to the channel ramp portion and is configured to support a shoulder portion of the dispensing bottle, when the dispensing bottle is in at least one of the freestanding primary position and the freestanding secondary position, and when the dispensing bottle is in the freestanding primary position a central axis of the dispensing bottle is situated at a first angle relative to a horizontal axis extending along a bottom portion of the dispenser cradle, and when the dispensing bottle is in the freestanding secondary position, a central axis of the dispensing bottle is situated at a second angle relative to the horizontal axis that is greater than the first angle; and a top surface formed on at least part of the front portion and extending proximate to the shoulder support surface, where the first support arm and second support arm are angled upwardly relative to the shoulder support surface and the top surface is configured to support the shoulder portion of the dispensing bottle when the dispensing bottle is in a freestanding tertiary position, and when the dispensing bottle is in the freestanding tertiary position the central axis of the dispensing bottle is situated at a third angle relative to the horizontal axis extending along a bottom portion of the dispenser cradle;

wherein the dispenser cradle further comprises four corners and leg supports protruding from each corner; wherein each leg support includes a cavity formed in a lower surface of each leg support, wherein the cavities of the leg supports are configured to receive upright leg posts in order to elevate the dispenser cradle and the dispensing bottle above a support surface.

* * * * *